US005690547A

United States Patent [19]

Holland, Jr. et al.

[11] Patent Number: 5,690,547

[45] Date of Patent: Nov. 25, 1997

[54] CORNER SANDER FOR MANUALLY SANDING AN OUTSIDE CORNER OF A WALL STRUCTURE

[76] Inventors: Wayne H. Holland, Jr., 13215 Leadwell St.; Patrick L. Ilejay, 7256 Hinds Ave., both of North Hollywood, Calif. 91605

[21] Appl. No.: 703,194

[22] Filed: Aug. 26, 1996

[51] Int. Cl.[6] ..... B24D 15/00

[52] U.S. Cl. ..... 451/524; 451/523

[58] Field of Search ..... 451/524, 523, 451/520–522, 525

[56] References Cited

U.S. PATENT DOCUMENTS

| | | | |
|---|---|---|---|
| 2,036,107 | 3/1936 | Thomas | 451/522 |
| 2,817,931 | 12/1957 | Houser | 451/522 |
| 3,279,130 | 10/1966 | Nelson | 451/524 |
| 3,714,743 | 2/1973 | Hall | 451/524 |
| 4,774,789 | 10/1988 | Amalfi | 451/525 |
| 4,825,597 | 5/1989 | Matechuk | 451/524 |

*Primary Examiner*—Robert A. Rose
*Assistant Examiner*—George Nguyen
*Attorney, Agent, or Firm*—Kelly Bauersfeld Lowry & Kelley, LLP

[57] ABSTRACT

A sander device is provided for sanding an outside corner of a structure, such as a building wall or a furniture item or the like, defined by a pair of angularly oriented surfaces. The sander device comprises a mounting bracket defining a pair of support plates oriented at a selected angle, e.g., a right angle, relative to each other, and wherein the support plates are adapted to receive and support sandpaper sheets at the selected angle. The mounting bracket with sandpaper sheets mounted thereon is removably mounted onto a base which includes a handgrip to facilitate manipulation of the sander device relative to a corner structure to be sanded.

10 Claims, 3 Drawing Sheets

CORNER SANDER FOR MANUALLY SANDING AN OUTSIDE CORNER OF A WALL STRUCTURE

BACKGROUND OF THE INVENTION

This invention relates generally to a relatively simple and easy to use sander device for sanding an outside corner of a structure.

A variety of sander devices are generally known in the art, particularly such as blocks of wood or the like adapted to receive and support a sheet of sandpaper as the block and sandpaper are manually moved together over a surface to be sanded. Such devices may function satisfactorily in many applications, such as sanding a generally planar surface. Moreover, such devices have been used with varying success in sanding inside corner structures defined by a pair of surfaces oriented at a right angle to each other. However, conventional sanding blocks of this type have not been satisfactory for use in sanding an outside corner structure.

SUMMARY OF THE INVENTION

The present invention provides an improved sander device designed especially for sanding an outside corner of a structure. The corner sander can be used to sand any pair of adjacent structural surfaces defining an outside corner, wherein such surfaces are typically oriented at a right angle to each other. It will be understood, however, that the invention can be adapted for use in sanding outside corners defined by surfaces disposed at other angles. Exemplary applications of the present invention include sanding wallboard surfaces during building construction and/or remodeling, and sanding outside corners of furniture and other wooden structures etc.

The sander device comprises a mounting bracket defining a pair of support plates oriented at a selected angle, e.g., a right angle, relative to each other, and wherein the support plates are adapted to receive and support sandpaper sheets at the selected angle. The mounting bracket with sandpaper sheets mounted thereon is removably mounted onto a base which includes a handgrip to facilitate manipulation of the sander device relative to a corner structure to be sanded.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 3:
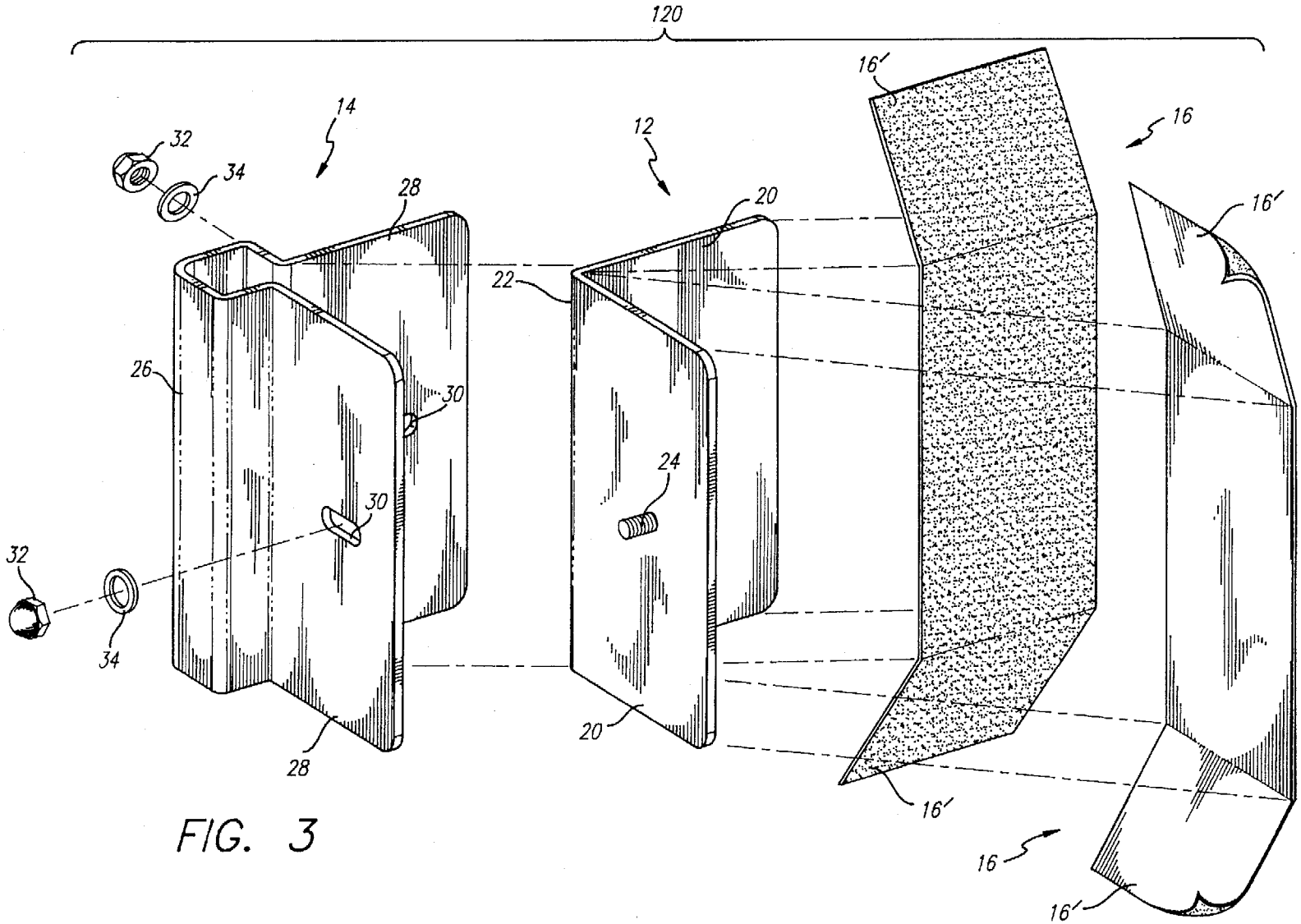
FIG. 3 is an exploded perspective view of the sander device of FIGS. 1 and 2, showing screws and related nuts for removably connecting the mounting bracket to the base, and further showing cooperation between the mounting bracket and base for releasibly retaining the sandpaper sheets on the mounting bracket.

As shown in the exemplary drawings, the corner sander of the present invention is referred to generally by the reference numeral 10. The corner sander 10 comprises a mounting bracket 12 (FIG. 3) in combination with a base 14 for supporting and retaining a pair of sandpaper sheets 16 in proper orientation to sand an outside corner 18 (FIG. 1) of a selected structure. The mounting bracket 12 and the base 14 may be conveniently formed from extruded metal such as aluminum, or from a suitable molded plastic.

Figure 4:
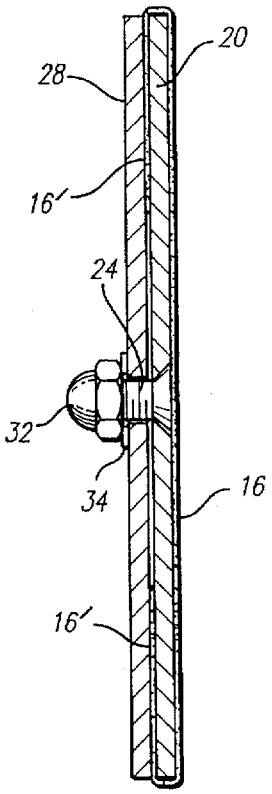
FIG. 4 is a vertical sectional view taken generally on the line 4—4 of FIG. 2.
Figure 5:
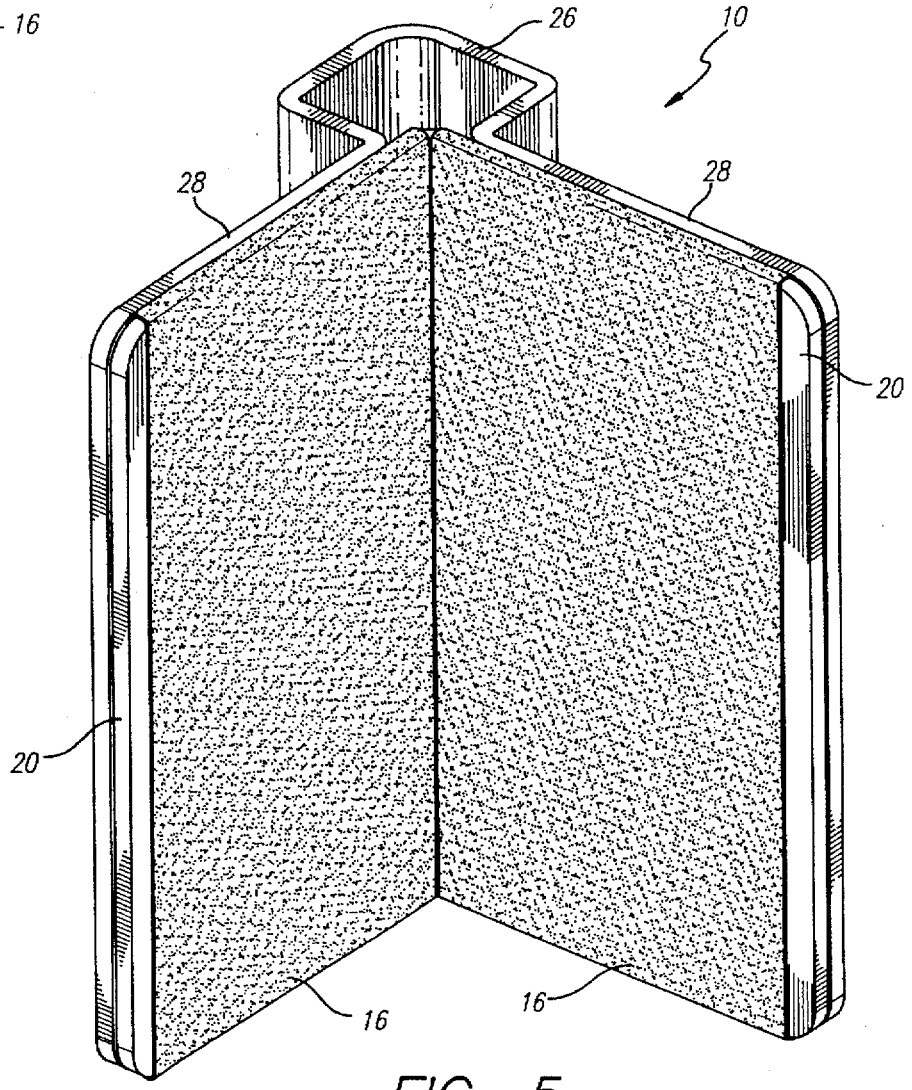
FIG. 5 is a front perspective view of the corner sander shown in FIG. 2.

The mounting bracket 12 defines a pair of generally rectangular support plates 20 joined to each other along a common side edge 22, and oriented at a selected angle such as a right angle as shown. The two support plates 20 each have a flat and generally planar forward-facing surface to define a smooth and stable backstop for a respective one of the sandpaper sheets 16 which are shown to be generally rectangular with upper and lower margins 16' folded over the upper and lower margins of the respective support plates 20. Mounting screws 24 (FIGS. 3 and 4) protrude rearwardly from the support plates 20. As shown (FIG. 4), the heads of these mounting screws 24 lie flush with the forward-facing surface of the associated support plate 20.

The base 14 includes a central hand grip 26 having a size and shape for relatively easy manual gripping and handling of the sander device 10, as will be described. The hand grip 26 is shown with an elongated hollow and squared configuration formed between and integral with a pair of outwardly projecting backstop plates 28 oriented at the same angle as the support plates 20 of the mounting bracket 12. The backstop plates 28 have elongated or oblong screw ports 30 formed therein with an elongated axis extending away from the hand grip 26, to accommodate reception of the support plate mounting screws 24 as the mounting bracket 12 is nested within the backstop plates 28. Nuts 32 and washers 34 are fastened onto the screws 24 to lock the mounting bracket 12 and base 14 together with a clamping action.

Figure 1:
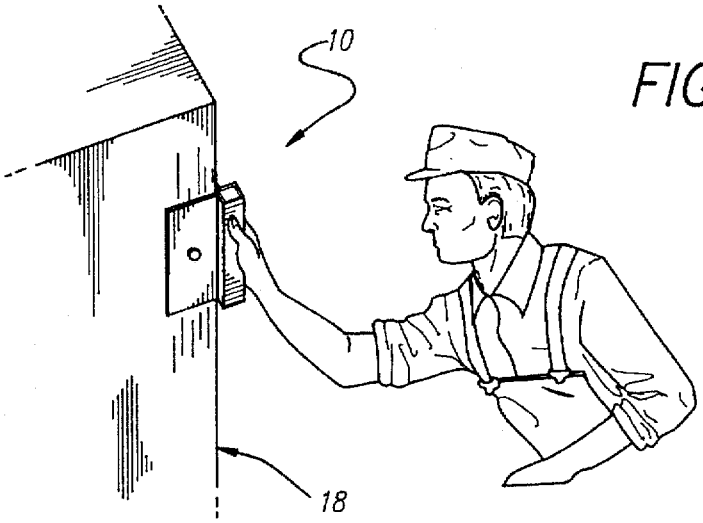
FIG. 1 is a perspective view showing use of the corner sander of the present invention to sand an outside corner of a building structure, such as a corner surface defined by a pair of walls intersecting at a right angle.
Figure 2:
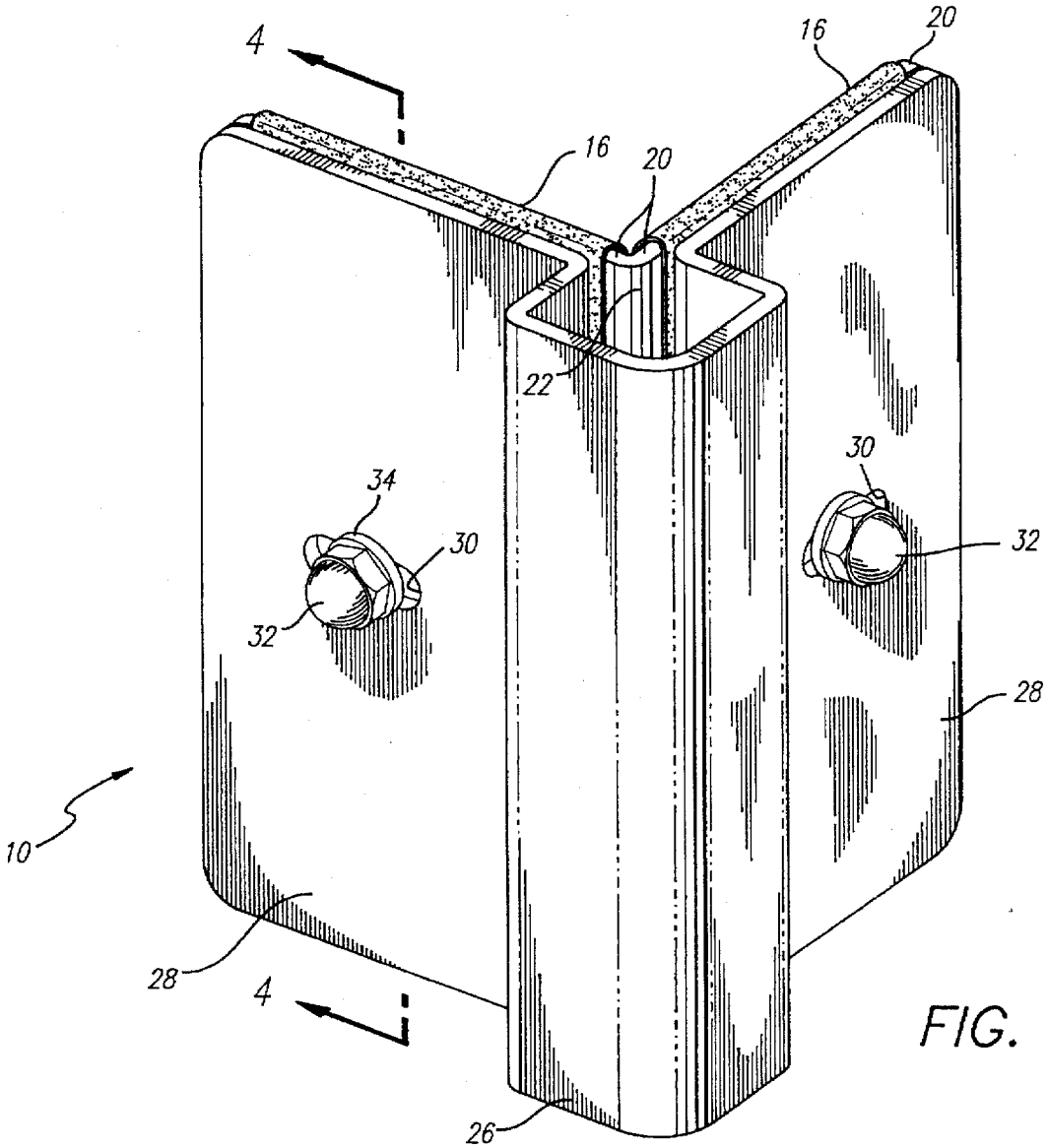
FIG. 2 is an enlarged rear perspective view of the corner sander of FIG. 1 showing a mounting bracket defining a pair of support plates with sheets of sandpaper respectively carried thereon, with the mounting bracket connected in a nested manner to a base having a handgrip for ease of manipulating the sandpaper over an outside corner structure to be sanded.

The assembled bracket 12 and base 14 securely retain and support the sandpaper sheets 16 in position to sand the outside corner 18 of a structure. That is, the upper and lower margins 16' of the sheets 16 are pinched and retained between the bracket 12 and the base 14 to hold the sandpaper sheets 16 tightly in place. The assembled device 10 can then be manipulated by use of the handgrip 26 over the outside corner structure 18 during a sanding procedure. FIG. 1 shows such usage relative to a vertical corner as defined, for example, by a pair of walls intersecting at a right angle. Such outside corner geometries are relatively commonly defined by wallboard structures within a building. It will be understood, however, that the sander device 10 can be used to sand different corner structures formed from wood or other materials. Moreover, it will be understood that the sander 10 can be constructed to orient and support the sandpaper sheets 16 at any selected angle. Still further, it will be recognized that the twin sandpaper sheets can be replaced by a single sheet folded to nest within the support plates, with upper and lower margins suitably slitted to fit over the support plate margins.

A variety of further modifications and improvements to the corner sander 10 of the present invention will be apparent to those skilled in the art. Accordingly, no limitation on the invention is intended by way of the foregoing description and accompanying drawings, except as set forth in the appended claims.

What is claimed:

1. A non-mechanized corner sander for manually sanding an outside corner of a wall structure, comprising:

a pair of support plates for receiving and supporting a pair of sandpaper sheets;

a base formed of a rigid plate bent to define a handgrip and a pair of backstop plates extending outwardly from said handgrip at a selected angle relative to each other so as to receive the outside corner of the wall structure therebetween; and means for removably connecting said pair of support plates respectively to said backstop plates.

2. The corner sander of claim 1 wherein said pair of support plates are connected to each other and are oriented angularly relative to each other at an angle generally conforming to the angular orientation of said backstop plates.

3. The corner sander of claim 2 wherein said connecting means comprises a pair of screws respectively on said support plates for reception through elongated slots formed respectively in said backstop plates, and a pair of nuts for threaded mounting onto said screws to retain said support and backstop plates in clamped together relation.

4. The corner sander of claim 1 wherein said backstop plates are oriented generally at a right angle to each other.

5. A corner sander for manually sanding an outside corner of a wall structure, comprising:

a mounting bracket formed of a first rigid plate bent to define a pair of support plates oriented at a selected angle relative to each other so as to receive the outside corner of the wall structure therebetween, said support plates each defining a front face for receiving and supporting a respective sheet of sandpaper;

a base defining a pair of backstop plates oriented generally at an angle conforming to said support plates, said backstop plates being joined together by a handgrip; and means for connecting said mounting bracket to said base in nested and clamped relation, whereby edges of the sandpaper sheet folded over said support plates are pinched and retained between said support plates and said backstop plates.

6. The corner sander of claim 5 wherein said base comprises a second rigid plate bent to define the handgrip and the backstop plates.

7. The corner sander of claim 5 wherein said connecting means comprises a pair of screws respectively on said support plates for reception through elongated slots formed respectively in said backstop plates, and a pair of nuts for threaded mounting onto said screws to retain said support and backstop plates in clamped together relation.

8. The corner sander of claim 5 wherein said selected angle is a right angle.

9. A non-mechanized corner sander for manually sanding an outside corner of a wall structure, comprising:

a mounting bracket formed of a first rigid plate bent to define a pair of support plates oriented at a selected angle relative to each other so as to receive the outside corner of the wall structure, said support plates each defining a front face for receiving and supporting a respective sheet of sandpaper;

a base formed of a second rigid plate bent to define a handgrip and a pair of backstop plates oriented generally at an angle conforming to said support plates; and means for connecting said mounting bracket to said base in nested and clamped relation, whereby edges of the sandpaper sheet folded over said support plates are pinched and retained between said support plates and said backstop plates, wherein said connecting means comprises a pair of screws respectively on said support plates for reception through elongated slots formed respectively in said backstop plates, and a pair of nuts for threaded mounting onto said screws to retain said support and backstop plates in clamped together relation.

10. The corner sander of claim 9 wherein said selected angle is a right angle.

* * * * *